US007754408B2

(12) United States Patent
Kumar et al.

(10) Patent No.: US 7,754,408 B2
(45) Date of Patent: Jul. 13, 2010

(54) SYNTHETIC CARRIERS

(75) Inventors: Samir Kumar, Pittsford, NY (US); Dan A. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 950 days.

(21) Appl. No.: 11/238,112

(22) Filed: Sep. 29, 2005

(65) Prior Publication Data

US 2007/0072108 A1 Mar. 29, 2007

(51) Int. Cl.
*G03G 9/10* (2006.01)

(52) U.S. Cl. ..... 430/111.31; 430/111.3

(58) Field of Classification Search ..... 430/111.35, 430/111.32, 111.3, 111.31
See application file for complete search history.

(56) References Cited

U.S. PATENT DOCUMENTS

| | | | | |
|---|---|---|---|---|
| 3,590,000 | A | | 6/1971 | Palermiti et al. |
| 4,426,433 | A | | 1/1984 | Kohri et al. |
| 4,558,108 | A | | 12/1985 | Alexandru et al. |
| 4,565,765 | A | | 1/1986 | Knapp et al. |
| 4,771,314 | A | | 9/1988 | Parker et al. |
| 4,833,504 | A | | 5/1989 | Parker et al. |
| 4,847,655 | A | | 7/1989 | Parker et al. |
| 4,868,600 | A | | 9/1989 | Hays et al. |
| 4,868,608 | A | | 9/1989 | Allen, Jr. et al. |
| 4,901,114 | A | | 2/1990 | Parker et al. |
| 4,948,686 | A | | 8/1990 | Koch et al. |
| 4,984,019 | A | | 1/1991 | Folkins |
| 5,010,367 | A | | 4/1991 | Hays |
| 5,031,570 | A | | 7/1991 | Hays |
| 5,032,872 | A | | 7/1991 | Folkins et al. |
| 5,061,969 | A | | 10/1991 | Parker et al. |
| 5,119,147 | A | | 6/1992 | Hays |
| 5,134,442 | A | | 7/1992 | Folkins et al. |
| 5,144,371 | A | | 9/1992 | Hays |
| 5,153,647 | A | | 10/1992 | Barker et al. |
| 5,153,648 | A | | 10/1992 | Lioy et al. |
| 5,171,653 | A | | 12/1992 | Jugle et al. |
| 5,172,170 | A | | 12/1992 | Hays et al. |
| 5,206,693 | A | | 4/1993 | Folkins |
| 5,212,037 | A | | 5/1993 | Julien et al. |
| 5,227,460 | A | | 7/1993 | Mahabadr et al. |
| 5,245,392 | A | | 9/1993 | Behe et al. |
| 5,253,016 | A | | 10/1993 | Behe et al. |
| 5,278,020 | A | | 1/1994 | Grushkin et al. |
| 5,290,654 | A | | 3/1994 | Sacripante et al. |
| 5,300,992 | A | | 4/1994 | Wayman et al. |
| 5,308,734 | A | | 5/1994 | Sacripante et al. |
| 5,311,258 | A | | 5/1994 | Brewington et al. |
| 5,344,738 | A | | 9/1994 | Kmiecik-Lawrynowicz et al. |
| 5,346,797 | A | | 9/1994 | Kmiecik-Lawrynowicz et al. |
| 5,364,729 | A | | 11/1994 | Kmiecik-Lawrynowicz et al. |
| 5,370,963 | A | | 12/1994 | Patel et al. |
| 5,403,693 | A | | 4/1995 | Patel et al. |
| 5,418,108 | A | | 5/1995 | Kmiecik-Lawrynowicz et al. |
| 5,510,220 | A | | 4/1996 | Nash et al. |
| 5,593,807 | A | | 1/1997 | Sacripante et al. |
| 5,629,119 | A | | 5/1997 | Inoue et al. |
| 5,663,027 | A | | 9/1997 | Kohri et al. |
| 5,686,182 | A | * | 11/1997 | Maniar ..... 430/111.35 |
| 5,736,287 | A | * | 4/1998 | Kobayashi et al. ..... 430/122.2 |
| 6,165,663 | A | * | 12/2000 | Baba et al. ..... 430/111.3 |
| 6,177,221 | B1 | | 1/2001 | Maniar et al. |
| 6,319,647 | B1 | | 11/2001 | Gutman et al. |
| 6,355,194 | B1 | | 3/2002 | Agur et al. |
| 6,365,316 | B1 | | 4/2002 | Stamp et al. |
| 6,416,916 | B1 | | 7/2002 | Silence et al. |
| 6,764,799 | B2 | | 7/2004 | Skorokhod et al. |

OTHER PUBLICATIONS

Diamond, Arthur S & David Weiss (eds.) Handbook of Imaging Materials, 2nd ed.. New York: Marcel-Dekker, Inc. (Nov. 2001) pp. 209-220.*

* cited by examiner

*Primary Examiner*—Christopher RoDee
(74) *Attorney, Agent, or Firm*—Oliff & Berridge, PLC

(57) ABSTRACT

A carrier includes at least one magnetic material and a conductive material. The conductive material is at least one carbon nanotube. A developer includes a toner and the carrier.

17 Claims, No Drawings

SYNTHETIC CARRIERS

TECHNICAL FIELD

Described herein is a carrier bead composite material that includes a binder, at least one magnetic material and a conductive material, wherein the conductive material is at least carbon nanotubes, and an electrophotographic imaging apparatus and developer including the carrier.

BACKGROUND

Certain synthetic carriers are known, for example, U.S. Pat. No. 4,426,433 discloses a carrier with a binder and a powder of a magnetizable material dispersed therein, and carbon black. The resin binder includes styrene butadiene polymers, and the magnetite can be MAPICO BLACK™. Also, U.S. Pat. No. 5,663,027 discloses a carrier of a binder resin, such as a polyester, or a styrene/acrylic copolymer, and a magnetite such as $FeO.Fe_2O_3$. In U.S. Pat. No. 4,565,765, there is illustrated a carrier composition comprised of a resin binder of for example, polyamides, epoxies, polyurethanes, polyesters, styrene acrylates, and magnetites like MAPICO BLACKS™. Carbon black can also be included in the carrier according to the disclosure of U.S. Pat. No. 4,565,765. Moreover, in U.S. Pat. No. 5,629,119 there is disclosed melt kneading processes for the preparation of a two component binder type magnetic carrier comprised of a magnetic powder and a binder resin wherein the carrier selected contains therein a release agent.

There are disclosed in U.S. Pat. No. 4,565,765 processes for the preparation of synthetic carriers containing a MAPICO BLACK™ magnetite up to 60 percent by weight of carrier, and VULCAN XC72R™ carbon black up to 8 percent by weight of carrier. The compositions can be ground in a Fitzmill and screened to an average particle size of about 75 microns. The MAPICO BLACK™ magnetite disclosed in U.S. Pat. No. 4,565,765 has a coercivity less than 200 gauss, and therefore is considered soft magnetic. To prepare a hard magnetic carrier, there is selected a hard magnetic powder such as, for example, strontium ferrite which is more insulative than MAPICO BLACK™ magnetite. The induced magnetic moment of a synthetic carrier in an applied magnetic field is a function of the concentration of magnetic material in the carrier particle. It is, therefore, preferred to maximize the amount of magnetic material contained in the carrier particle.

In conductive carriers, it may be desirable to have a conductive binder resin, that is, wherein the binder resin contains sufficient amounts of a conductive additive such as, for example, conductive carbon black, to render the carrier particle conductive. In U.S. Pat. No. 4,565,765, conductive carbon black concentrations of about 8 percent by weight of carrier are disclosed. Together with the MAPICO BLACK™ magnetite, this level of carbon black renders the carrier particle conductive. Possibly affecting the conductivity of the carrier is how the carbon black is dispersed in the binder resin. If the conductive material, such as carbon black, is dispersed too finely, then the carrier conductivity will be lower than if the level of dispersion is more moderate.

Conductive, magnetic synthetic carriers can be used in electrophotographic printers and copiers to form a two-component mixture of carrier and toner that is triboelectrically charged for the development of electrostatic images. However, present methods of manufacturing synthetic carriers require a high percentage loading of carbon black to achieve sufficient conductivity of the developer. This high loading tends to preclude the control of the triboelectric charging properties since the high carbon black loading dominates the surface properties. Present synthetic carriers have low density but do not have the desired high conductivity with acceptable triboelectric charging. Known synthetic carriers can provide reasonable triboelectric charging but the conductivity is $10^{-10}$ S/cm, which may be unacceptable in many development systems.

Furthermore, known high-density carriers composed of ferrites or metals such as steel are highly abusive to toners in a development system, which may cause severe developer degradation over time. Specifically, the toner is so abused that its adhesion and triboelectric charging properties can be degraded. The toner abuse increases for low document area coverage, in which case toner residing in the developer housing for an extended time can be subjected to considerable mechanical abuse.

Thus, a low-density synthetic carrier having high conductivity and acceptable triboelectric charging that decreases toner abuse in development systems is still desired.

SUMMARY

In embodiments, disclosed is a synthetic carrier including a binder, at least one magnetic material and at least one conductive material. The conductive material comprises at least one carbon nanotube. The carrier may optionally include a charge enhancing additive.

In embodiments, disclosed is a developer comprising a carrier and a toner, wherein the carrier comprises a binder, at least one magnetic material and at least one conductive material, wherein the conductive material includes at least carbon nanotubes.

In embodiments, disclosed is an electrophotographic image forming apparatus including a photoreceptor, a development system, and a housing in association with the development system for a developer comprising a carrier and a toner, wherein the carrier comprises a binder, at least one magnetic material and at least one conductive material, and wherein the conductive material includes at least carbon nanotubes.

EMBODIMENTS

The process of electrophotographic printing generally includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed by bringing a developer comprised of toner into contact therewith.

Two component developer materials are commonly used. A typical two-component developer material comprises carrier beads having toner particles adhering triboelectrically thereto. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

In embodiments, conductive magnetic brush development systems as utilized in hybrid jumping development, hybrid scavengeless development, and similar processes, may be selected for use herein. See, for example, U.S. Pat. No. 4,868,600, U.S. Pat. No. 5,010,367, U.S. Pat. No. 5,031,570, U.S. Pat. No. 5,119,147, U.S. Pat. No. 5,144,371, U.S. Pat. No.

5,172,170, U.S. Pat. No. 5,300,992, U.S. Pat. No. 5,311,258, U.S. Pat. No. 5,212,037, U.S. Pat. No. 4,984,019, U.S. Pat. No. 5,032,872, U.S. Pat. No. 5,134,442, U.S. Pat. No. 5,153,647, U.S. Pat. No. 5,153,648, U.S. Pat. No. 5,206,693, U.S. Pat. No. 5,245,392 and U.S. Pat. No. 5,253,016, the disclosures of which are totally incorporated herein by reference.

The aforementioned development systems, which can contain a negatively charging toner, are suitable for use in known devices and with known components, for example including with laser or LED printers, and devices employing organic photoconductive imaging members with a photogenerating layer and a charge transport layer on a belt or drum, light lens xerographic devices, devices employing charged area development on, for example, inorganic photoconductive members such as selenium, selenium alloys like selenium, arsenic, tellurium, and hydrogenated amorphous silicon, devices employing tri-level xerography, and the like, reference U.S. Pat. No. 4,847,655, U.S. Pat. No. 4,771,314, U.S. Pat. No. 4,833,504, U.S. Pat. No. 4,868,608, U.S. Pat. No. 4,901,114, U.S. Pat. No. 5,061,969, U.S. Pat. No. 4,948,686 and U.S. Pat. No. 5,171,653, the disclosures of which are totally incorporated herein by reference, as well as devices employing fill color or mono-color xerography, and the like, reference for example the Xerox Corporation DocuColor iGen3® Digital Production Press and Xerox Nuvera® 100/120/144.

Examples of conductive magnetic brush development systems for use herein include hybrid jumping development (HJD) and hybrid scavengeless development (HSD).

In a HJD system, a conductive magnetic brush roll is used to load toner on donor rolls. A combination of AC and DC electric fields is used to develop toner from the toned donor rolls to the photoreceptor with an electrostatic image. The AC electric field is used for toner cloud generation and has a typical potential of 2.6 kV peak-to-peak (pp) at a 3.25 kHz frequency. The DC electric field is used to control the amount of developed toner mass on the photoreceptor.

HSD technology is similar to HJD in that toner is loaded on donor rolls from a biased conductive magnetic brush. However, a plurality of electrode wires is closely spaced from the toned donor roll in the development zone. An AC voltage is applied to the wires to generate a toner cloud in the development zone. This donor roll generally consists of a conductive core covered with a thin, for example 50-200 μm, charge relaxable layer. The magnetic brush roll is held at an electrical potential difference relative to the donor core to produce the field necessary for toner deposition. The toner layer on the donor roll is then disturbed by electric fields from a wire or set of wires to produce and sustain a cloud of toner particles. Typical AC voltages of the wires relative to the donor are 700-900 Vpp at frequencies of 5-15 kHz. These AC signals are often square waves, rather than pure sinusoidal waves. Toner from the cloud is then developed onto the nearby photoreceptor by fields created by a latent electrostatic image.

In any HJD or HSD system, the toner may be abused in the system in the process of producing an image on a image recording medium, such as paper. For example, the toner may be partially abused by impact with carrier particles in the development system. Accordingly, a less abusive carrier particle and development system are desired.

In embodiments, the carrier particles may be conductive carrier particles. For development systems that utilize a conductive magnetic brush of developer, it is desired that the conductivity of carrier particles be greater than $10^{-9}$ mho/cm, such as $10^{-9}$ mho/cm to about $10^{-4}$ mho/cm. In embodiments, the carrier particles may comprise a binder resin, magnetic component(s) and conductive component(s) that include at least one carbon nanotube. The carrier particles may optionally include charge enhancing additives.

Examples of carrier binder resin include polymers or copolymers selected from polyamides, epoxies, polyurethanes, silicone polymers, diolefins, vinyl resins, styrene acrylates, polymethyl methacrylates, styrene methacrylates, styrene butadienes, polyesters such as the polymeric esterification products of a dicarboxylic acid and a diol comprising a diphenol, crosslinked polyesters, and the like. Specific vinyl monomers include styrene, p-chlorostyrene, vinyl naphthalene, unsaturated monoolefins such as ethylene, propylene, butylene, and isobutylene; vinyl halides such as vinyl chloride, vinyl bromide, and vinyl fluoride; vinyl esters such as vinyl acetate, vinyl propionate, vinyl benzoate and vinyl butyrate; vinyl ethers, inclusive of vinyl methyl ether, vinyl isobutyl ether and vinyl ethyl ether; vinyl ketones inclusive of vinyl methyl ketone, vinyl hexyl ketone and methyl isopropenyl ketone; monocarboxylic acids and their derivatives such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide and trifluoroethyl methacrylate; dicarboxylic acids having a double bond and their derivatives such as maleic acid, monobutyl maleate, and dibutyl maleate; unsaturated monoolefins such as ethylene, propylene, butylene and isobutylene; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, and mixtures thereof. In embodiments, the binder resin may include crosslinked polymers with a degree or an amount of crosslinking in the range from about 1 to about 50 percent, such as from about 5 to about 40 percent.

In embodiments, the binder resin is present in an amount of, for example, from about 10 to about 50 percent, such as from about 15 to about 30 percent, by weight of carrier.

In embodiments, suitable magnetic components, such as magnetic powders, may be selected in an amount of, for example, from about 50 to about 85 percent, such as from about 60 to about 75 percent by weight, of the carrier particle. In embodiments, the magnetic components have a volume average diameter of from about 5 μm to about 0.01 μm, such as from about 2 μm to about 0.01 μm, as measured by a Coulter Counter.

In embodiments, magnetic components that may be selected include magnetite, magnetic ferrites, gamma ferric oxide, mixtures thereof, and ferrites containing iron as the major metallic component. In embodiments, ferrites may also include barium ferrites, strontium ferrites, and lead ferrites. The magnetic component may be a mixture of any of the foregoing examples. The magnetic component may enable the toner particles to acquire a positive or a negative charge and provide a carrier that will permit desirable flow properties in the developer reservoir in the xerographic imaging apparatus. Also of value with regard to the carrier properties may be, for example, desirable aging characteristics.

In embodiments, the conductive material may include at least carbon nanotubes. The carbon nanotubes may be used as the conducting material in synthetic carriers in order to enable higher conductivity without substantially adversely affecting the carrier's triboelectric charging properties.

Examples of suitable carbon nanotubes include, but are not limited to, multi-walled carbon nanotubes, single-walled carbon nanotubes, herringbone nanotubes, and the like.

In embodiments disclosed herein, the carrier may include at least multi-walled carbon nanotubes. Multi-walled carbon nanotubes are rope-like structures that provide effective conductive pathways within the carrier. The average number of walls for each carbon nanotube may vary from about 3 to about 25, such as from about 5 to about 18. The outside diameter of the multi-walled carbon nanotube may be from about 5 nm to about 30 nm, such as from about 8 to about 20, while the inside diameter of the multi-walled carbon nanotube may be from about 3 nm to about 10 nm, such as from about 4 to about 8.

In embodiments, the conductive material may include a mixture of carbon nanotubes and another conductive material, such as carbon spheres, carbon black, or carbon fibers. In such embodiments, the carbon nanotube may comprise from about 0.5 weight % to about 8 weight % by carrier weight, such as from about 1 weight % to about 5 weight %, and the other conductive material may comprise from about 5 weight % to about 40 weight % by carrier weight, such as from about 5 weight % to about 30 weight %.

Carbon nanotubes are electrically conductive additives with an extremely small size and a high length-to-diameter (L/D) aspect ratio. Due to the increased aspect ratio, carbon nanotubes may typically be tens of micrometers in length. This results in aspect ratios on the order of from about 100 to 10,000, such as from about 100 to about 1000. Carbon nanotubes may be significantly smaller than carbon fibers and are morphologically distinct from the familiar, nodular carbon black aggregates.

The resulting morphology may enable the carbon nanotubes to form a conducting network within a polymer matrix at an effective low loading percentage. For example, the carbon nanotube may comprise from about 1 weight % to about 15 weight % by carrier weight, for example from about 1 weight % to about 6 weight % of the carrier. Such a low loading percentage is well below the effective loading percentage of other available conductive materials as shown in table 1 below.

TABLE 1

| TYPE (L/D) | LOADING PERCENTAGE (WT %) |
|---|---|
| Carbon Spheres (about 1) | 35-40 |
| Carbon Black (about 10) | 15-20 |
| Carbon Fiber (about 100) | 8-10 |
| Carbon Nanotube (about 1000) | 1.5-4.5 |

Further, the carbon nanotubes are desirably highly isotropic and provide substantially uniform conductivity throughout the polymer composite. Carbon nanotubes may be processed with a polymeric binder with only a limited increase in melt viscosity. Using carbon nanotubes in polymeric binders further results in a substantially uniformly dispersed conductive materials in a carrier particle having a reduced tendency to slough conductive particles.

The flow properties of the carrier may be in the range of about 1.3 to about 2.5 g/sec, such as from of about 1.8 to about 2.5 g/sec, as measured by the JIS Z2502 method. The specific gravity of the carrier may be in the range of about 3 to about 4 g/cm$^3$ as measured by mercury pycnometry.

Additionally, a synthetic carrier exhibits lower toner impaction as compared to the iron or ferrite carrier. Lowering carrier impaction reduces carrier aging and increases the life of the developer. Thus, the use of a synthetic carrier can reduce developer aging while providing satisfactory triboelectric properties as compared to other carrier cores.

Toner cohesion for toners removed from developers of both the nominal carriers, for example, iron or ferrite cores, and synthetic carriers at various toner concentrations show a clear difference. The toner cohesion for toners removed from developers made with a synthetic carrier after aging may typically be from about 10% to about 30%. However, the toner cohesion for toners removed from developers made with metal carriers after aging may typically be from about 10% to about 80%. Toner cohesion is generally measured with a Hosokawa® Powder Tester, available from Hosakawa Micron Corporation, to determine the percentage of cohesiveness.

Additionally, the rate of toner cohesion or "additive embedding" is also lower in systems using synthetic carriers. Lower toner cohesion means that there is reduced toner aging in the system. Reduced toner aging allows greater toner flow in the system for longer periods of time. This may improve or, at least, not result in a decrease in developability.

Processes of making carbon nanotubes are known. Such processes typically form aggregates that can be used without untangling. In the alternative, such aggregates may be untangled prior to use. In embodiments, these aggregates may be untangled via shear during compounding.

Carbon nanotubes are typically purchased in masterbatches, where the carbon nanotubes are dispersed in a thermoplastic resin. For example, Hyperion Catalysis, one manufacturer and distributor of carbon nanotubes, has a proprietary technology for dispersing carbon nanotubes in thermoplastic resins which are sold pre-dispersed in a polymer matrix having between 15 and 20 weight % carbon nanotubes. These masterbatches are available from Hyperion Catalysis in resins such as polystyrene, ethylene tetrafluoroethylene and polyvinylidene fluoride that represent either positive or negative triboelectric charging resins. In embodiments, carbon nanotubes purchased from Nanosperse, which are dispersed in polyester, may be used herein.

These can subsequently be let down in a twin-screw extruder, along with the desired amounts of magnetic components and charge control additives. The extrudate can then be ground to produce micron-sized powders for use in carriers.

In embodiments, the carrier particles may optionally include a charge enhancing additive, such as quaternary ammonium salts, and more specifically, distearyl dimethyl ammonium methyl sulfate (DDAMS), bis[1-[(3,5-disubstituted-2-hydroxy phenyl)azo]-3-(mono-substituted)-2-naphthalenolato(2-)]chromate(1-), ammonium sodium and hydrogen (TRH), cetyl pyridinium chloride (CPC), FANAL PINK D4830®, and the like, including those as specifically illustrated herein, and other effective known charge agents or additives. The charge additives are selected in various effective amounts, such as from about 0.05 to about 15, or from about 0.1 to about 3, weight percent of the carrier particles. The amount of charge additives is based on the sum of the weights of the binder resin, magnetic component, colorant, and charge additive components.

In embodiments, the carrier particles can be coated with a polymer coating. Any polymer disclosed herein may be utilized as a suitable polymer coating for the carrier particles described herein.

In embodiments, the carrier particles may be made by any known method. For example, the carrier particles may be made by physical methods, such as grinding, or chemical methods, such as emulsion aggregation. In embodiments, the carrier particles are made by a grinding process such as disclosed in U.S. Pat. No. 6,355,194, the disclosure of which is incorporated by reference herein in its entirety. In embodiments, the carrier particles are made by the emulsion/aggregation process such as disclosed in U.S. Pat. No. 6,764,799, the disclosure of which is incorporated by reference herein in its entirety.

Illustrative examples of toner compositions that can be selected for mixing with the carrier particles prepared in accordance with the present disclosure include conventional jetted toners, polyester emulsion aggregated (EA) toners and styrene/acrylate EA toners.

Suitable materials for use in preparing toners herein will now be discussed.

Any resin binder suitable for use in toner may be employed without limitation. Further, toners prepared by chemical methods (emulsion aggregated, for example) and physical methods (grinding) may be equally employed. Specific suitable toner examples are as follows.

The toner can be a polyester toner particle, which is known in the art. Polyester toner particles created by the EA-process are illustrated in a number of patents, such as U.S. Pat. No. 5,593,807, U.S. Pat. No. 5,290,654. U.S. Pat. No. 5,308,734, and U.S. Pat. No. 5,370,963, each of which are incorporated herein by reference in their entirety. The polyester may comprise any of the polyester materials described in the aforementioned references.

In embodiments, the toner may be a styrene/acrylate toner particle that is known in the art. Styrene/acrylate toner particles created by the EA process are illustrated in a number of patents, such as U.S. Pat. No. 5,278,020, U.S. Pat. No. 5,346,797, U.S. Pat. No. 5,344,738, U.S. Pat. No. 5,403,693, U.S. Pat. No. 5,418,108, and U.S. Pat. No. 5,364,729, each of which are incorporated herein by reference in their entirety. The styrene/acrylate may comprise any of the materials described in the aforementioned references.

The toner can be generated by well known processes other than by EA process. One such suitable process includes forming the toner by physical methods. Such toner particles are illustrated in a number of patents, such as U.S. Pat. No. 6,177,221, U.S. Pat. No. 6,319,647, U.S. Pat. No. 6,365,316, U.S. Pat. No. 6,416,916, U.S. Pat. No. 5,510,220, U.S. Pat. No. 5,227,460, U.S. Pat. No. 4,558,108, and U.S. Pat. No. 3,590,000, each of which are incorporated herein by reference in their entirety. These toners comprise materials described in the aforementioned references.

Various known colorants, such as pigments, present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours and Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans that may be selected include copper tetra (octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, Yellow 180 and Permanent Yellow FGL, wherein the colorant is present, for example, in the amount of about 3 to about 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, and more specifically, from about 5 to 20 weight percent of the toner. Colorants include pigment, dye, mixtures of pigment and dyes, mixtures of pigments, mixtures of dyes, and the like. This listing of colorants is for illustration only; any suitable colorant may be used herein. As understood by one of ordinary skill, pigments are predispersed in a surfactant or resin binder to facilitate mixing.

In electrophotographic imaging, developer compositions may comprise one or more toner compositions and one or more carrier compositions. Developers incorporating the coated carriers described herein can be generated by mixing the carrier core particles with a toner composition comprised of resin particles and pigment particles. Generally, from about 1 part to about 10 parts by weight of toner particles, such from about 1 part to about 5 parts by weight of toner particles, are mixed with from about 10 to about 400 parts by weight of the carrier particles, such as from about 10 to about 300 parts by weight of the carrier particles.

The toner concentration in the developer initially installed in a xerographic development housing may be from about 2.5 to about 6 parts of toner per one hundred parts of carrier, such as from about 3.6 to about 5 parts of toner per one hundred parts of carrier. Over the life of the developer, this concentration can vary from about 2.5 to about 11 parts of toner per one hundred parts of carrier, such from about 3.5 to about 9 parts of toner per one hundred parts of carrier, with no significant impact on the copy quality of the resulting images. In embodiments, the developer composition may have a breakdown voltage of about 10 V to about 1000 V, such as about 100 V.

EXAMPLES

FIBRIL® nanotubes in a masterbatch of polystyrene, purchased from Hyperion Catalysis, are let down with polystyrene in a twin-screw extruder to form a 4 to 5 weight % dispersion of nanotubes in the binder along with 40 to 70 weight % magnetite. This mixture is then ground in a fluid bed grinder to produce 50 to 70 μm powders to be used as synthetic carrier. A size classification is performed to tune the size distribution of carrier. The formed carrier particle has the same 4 to 5 weight % dispersion of nanotubes in the binder along with 40 to 70 weight % magnetite. The conductivity of this carrier is in the range of $10^{-9}$ to $10^{-7}$ mho/cm and has a tribo-charge of 20-30 microcoulombs/gm against Xerox Nuvera® 100/120/144 toner. The tribo-charge of the carrier was measured using a Faraday cage blow off apparatus, which is known in the art.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A carrier including carrier particles comprising a binder, at least one magnetic material and at least one conductive material, wherein the conductive material is substantially uniformly dispersed within the carrier particles and the conductive material includes at least one carbon nanotube.

2. The carrier according to claim 1, wherein the at least one carbon nanotube is a multi-walled carbon nanotube.

3. The carrier according to claim 2, wherein the multi-walled carbon nanotube comprises from about 3 walls to about 25 walls per multi-walled carbon nanotube.

4. The carrier according to claim 2, wherein the outer diameter of the carbon nanotube is from about 5 nm to about 30 nm, and the inside diameter of the carbon nanotube is from about 3 nm to about 10 nm.

5. The carrier according to claim 1, wherein the at least one carbon nanotube comprises from about 1 weight % to about 15 weight % of the carrier particles.

6. The carrier according to claim 1, wherein the binder is selected from the group consisting of polyamides, epoxies, polyurethanes, silicone polymers, diolefins, vinyl resins, styrene acrylates, polymethyl methacrylates, styrene methacrylates, styrene butadienes, polyesters, and mixtures thereof.

7. The carrier according to claim 1, wherein the at least one magnetic material is a magnetic powder.

8. The carrier according to claim 7, wherein the magnetic powder is selected from the group consisting of magnetite, gamma ferric oxide, ferrites containing iron as a primary metallic component, barium ferrites, strontium ferrites and lead ferrites.

9. The carrier according to claim 1, wherein the binder is from about 10 weight % to about 50 weight % of the carrier, and wherein the at least one magnetic material is from about 50 weight % to about 85 weight % of the carrier particles.

10. The carrier according to claim 1, wherein the carrier particles further comprise a charge enhancing additive.

11. The carrier according to claim 1, wherein the carrier particles are coated with a polymer coating.

12. A developer comprising a carrier and a toner, wherein the carrier includes carrier particles comprising a binder, at least one magnetic material and at least one conductive material, wherein the conductive material is substantially uniformly dispersed within the carrier particles and the conductive material includes at least one carbon nanotube.

13. The developer according to claim 12, wherein the at least one carbon nanotube is a multi-walled carbon nanotube.

14. The developer according to claim 13, wherein the multi-walled carbon nanotube comprises from about 3 walls to about 25 walls per multi-walled carbon nanotube.

15. The developer according to claim 13, wherein the outer diameter of the carbon nanotube is from about 5 nm to about 30 nm, and the inside diameter of the carbon nanotube is from about 3 nm to about 10 nm.

16. The developer according to claim 12, wherein the at least one carbon nanotube is from about 1 weight % to about 6 weight % of the carrier particles.

17. The developer according to claim 12, wherein the carrier particles further comprise a charge enhancing additive.

* * * * *